US007934344B2

(12) United States Patent
Truckner

(10) Patent No.: US 7,934,344 B2
(45) Date of Patent: May 3, 2011

(54) STAIRWAY STRINGER AND FINISHED STAIRWAY SKIRT BOARD

(75) Inventor: Richard Truckner, Pasadena, CA (US)

(73) Assignee: EZ Stairs, Inc., Laguna Hills, CA (US)

( * ) Notice: Subject to any disclaimer, the term of this patent is extended or adjusted under 35 U.S.C. 154(b) by 0 days.

(21) Appl. No.: 12/380,879

(22) Filed: Mar. 3, 2009

(65) Prior Publication Data

US 2009/0277105 A1 Nov. 12, 2009

Related U.S. Application Data

(62) Division of application No. 11/784,543, filed on Apr. 6, 2007, now Pat. No. 7,497,060.

(51) Int. Cl.
*E04F 11/00* (2006.01)

(52) U.S. Cl. ..... 52/183; 52/182; 52/741.2

(58) Field of Classification Search ..... 52/182, 52/183, 184, 185, 186, 188, 189, 190, 191, 52/741.2

See application file for complete search history.

(56) References Cited

U.S. PATENT DOCUMENTS

| | | | | | |
|---|---|---|---|---|---|
| 1,568,568 | A * | 1/1926 | Nagin | 52/191 |
| 2,205,859 | A * | 6/1940 | O'Donnell | 52/188 |
| 2,867,855 | A * | 1/1959 | Xanten | 182/97 |
| 3,196,997 | A * | 7/1965 | Hager | 52/182 |
| 4,124,957 | A * | 11/1978 | Poulain | 52/183 |
| 4,583,334 | A * | 4/1986 | Hubbard | 52/98 |
| 4,631,880 | A * | 12/1986 | Leicht | 52/105 |
| 4,819,391 | A * | 4/1989 | Tassin et al. | 52/182 |
| 4,875,315 | A * | 10/1989 | Champagne | 52/189 |
| 5,293,722 | A * | 3/1994 | Reimann | 52/182 |
| 5,636,483 | A * | 6/1997 | Wille | 52/188 |
| 5,787,664 | A * | 8/1998 | Hollander et al. | 52/300 |
| 5,791,101 | A * | 8/1998 | Wallace | 52/191 |
| 6,088,977 | A * | 7/2000 | Lawrence | 52/182 |
| 6,230,454 | B1 * | 5/2001 | Meagher | 52/182 |
| 6,354,403 | B1 * | 3/2002 | Truckner et al. | 182/228.1 |
| 6,397,529 | B1 * | 6/2002 | Grenier | 52/182 |
| 6,868,944 | B2 * | 3/2005 | Truckner et al. | 182/228.1 |
| 2002/0088669 | A1 * | 7/2002 | Truckner et al. | 182/228.1 |
| 2005/0081461 | A1 * | 4/2005 | Gibson | 52/188 |
| 2005/0138871 | A1 * | 6/2005 | Truckner | 52/182 |
| 2005/0160688 | A1 * | 7/2005 | Truckner et al. | 52/182 |
| 2007/0017169 | A1 * | 1/2007 | Gibson | 52/182 |

* cited by examiner

*Primary Examiner* — Robert J Canfield
*Assistant Examiner* — Matthew J Gitlin
(74) *Attorney, Agent, or Firm* — Walker, McKenzie & Walker, P.C.

(57) ABSTRACT

A stairway with a finished skirt/fascia board is formed using parallel stringers and tread/riser support brackets spaced and aligned along the stringers. The brackets are temporarily and pivotally attached to stringers and the stringers are moved parallel to and relative to each other to orient the stringers for the slope of the stairway. The pivotal attachment of the brackets to one of the stringers and the unattached stringer is moved into contact with the other stringer at mating faces. The brackets are them permanently attached to the parallel stringers. The mating faces of the stringers form a finished skirt/fascia board for the stairway. Several variations in contoured faces, including tongue and groove contours, for the mating surfaces provide for a smooth and clean looking skirt/fascia board on a finished stairway.

3 Claims, 4 Drawing Sheets

STAIRWAY STRINGER AND FINISHED STAIRWAY SKIRT BOARD

This application is a division of application Ser. No. 11/784,543, filed Apr. 6, 2007, now issued as U.S. Pat. No. 7,497,060.

This invention relates to the formation of a stairway and the finished appearance of the stringers along both sides of a stairway. Further the formation of a stairway using the apparatus and method of the present invention reduces the time required to align the stairway stringers and the time for installing risers and treads along a stairway while permitting the finished appearance of the skirt boards along the sides of the stairway to present an aesthetic smooth appearance.

PRIOR ART

Conventional stairway construction has required calculations based on the slope of the opening traversed by the stairway, calculations based on the spacing and rise of each stair, the cutting of a single board stringer with knee notches for the treads and risers of the stair, and the placement of the stringer in the opening to be traversed by the stairway. The first of these calculations is to get the proper slope for the stringer and then the division of that calculation into the needed separate steps to accomplish a stairway. These calculations are best accomplished by experienced carpenters to be assured that the knee notches are cut accurately and properly spaced. When a knee notched stringer is used it is difficult to produce a clean finished appearance in a matching skirt board along the side of the stairway. The apparatus and method of the present invention overcomes these difficulties

SUMMARY OF THE PRESENT INVENTION

In my prior patented inventions as shown in U.S. Pat. No. 6,354,403, issued Mar. 12, 2002; U.S. Pat. No. 6,839,977, issued Jan. 11, 2005; U.S. Pat. No. 6,868,944, issued Mar. 22, 2005; and U.S. Pat. No. 7,096,592, issued Aug. 29, 2006 I have disclosed an apparatus and method for forming a stairway using a pair of relatively movable parallel stringers with tread/riser support brackets and spacers for positioning treads and risers along a stairway. Those patents are incorporated herein by reference. With the use of the parallel stringers and brackets it is possible to easily assemble a stairway in almost any opening and with as many steps as needed to traverse an opening. A stairway formed using the parallel stringers and the present invention can then be placed against the studs along an opening or against the finished drywall along the opening as a skirt board or as a fascia board at the edge of the stairway. The present invention is directed to the formation of an aesthetically attractive finished stairway with a finished skirt board or fascia board along the edges of the stairway using the elements of the parallel stringer method.

OBJECTIVES OF THE PRESENT INVENTION

It is a primary objective of the present invention to provide the needed apparatus and method for the formation of a stairway of any slope and total steps while permitting the apparatus to be assembled in a finished aesthetic appearance.

A further objective in accord with the preceding objective is to provide stringer materials that can be formed as parallel stringers and later reassembled as a finished skirt board along a stairway.

Another objective in accord with the preceding objectives is the formation of a surface along mating edges of parallel stringers that will permit those edges to provide a smooth joint when assembled together.

Another objective in accord with the preceding objectives is provision of releasable pivotal mounting of brackets in the formation of parallel stringers and the hiding of previous mounting holes behind elements of the finished stairway.

Further objectives and features of the present invention will be readily apparent to those skilled in the art from the appended drawings and specifications illustrating preferred embodiments wherein:

DETAILED DESCRIPTION OF EMBODIMENTS

The present invention is an apparatus and method for the formation of a stairway using a pair of parallel stringers and spaced tread/riser support brackets that can be initially assembled for alignment of a stairway and later reassembled to form the stringers into a finished skirt board or fascia board along a stairway. The apparatus permits less skilled persons to form a properly spaced set of stair steps in an opening and finish the assembled stairway with an aesthetically attractive skirt board along the stairway.

Throughout this specification, a pair or set of parallel stringers with attached tread and riser brackets are described. It should be understood that a set of parallel stringers and brackets is intended for each side of a constructed stairway and that those sets will be carefully aligned and mounted in an opening before any treads and risers are attached to the brackets. The sets described here apply to both sides of a stairway.

Figure 1:
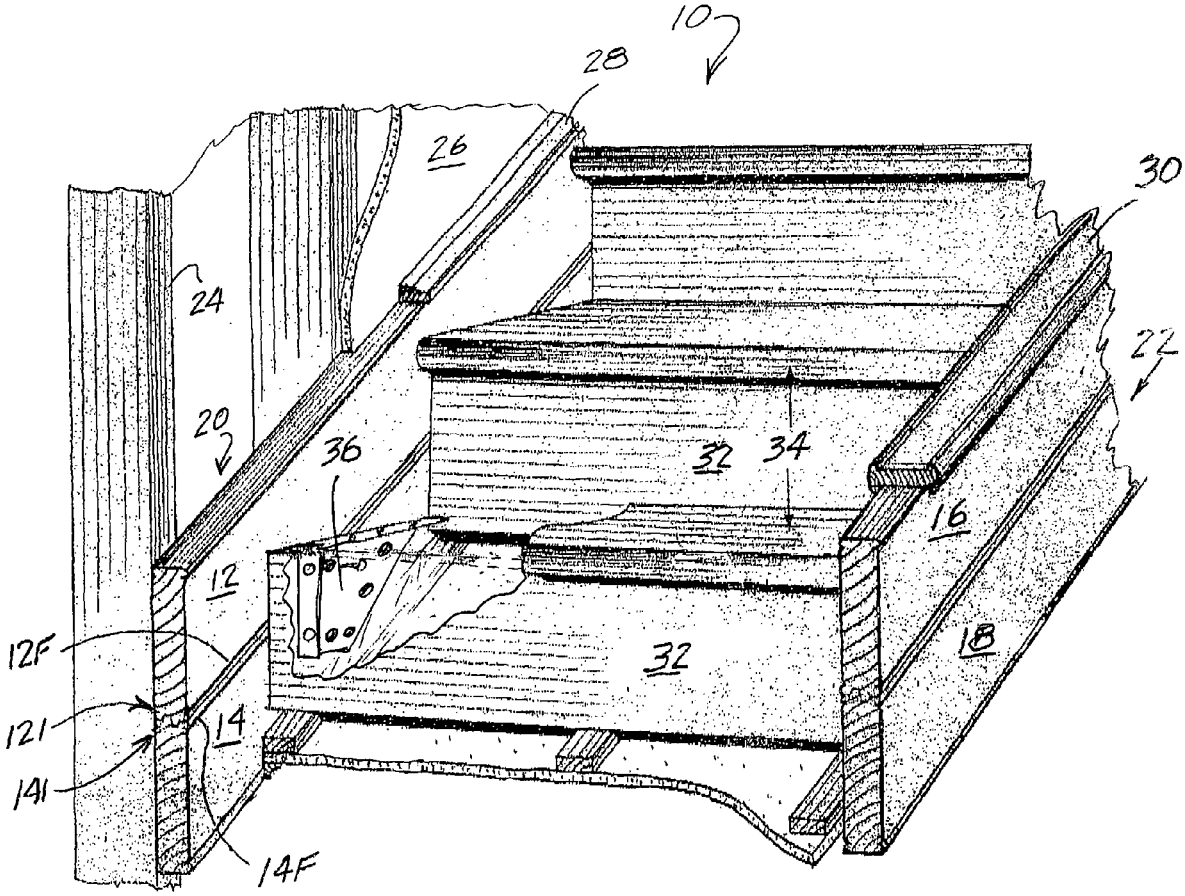
FIG. 1 is a perspective showing of a stairway formed initially with parallel stringers and with the stringers forming a finished skirt board or fascia board along the exposed face of stairway.

FIG. 1 illustrates in perspective a finished stairway 10 having parallel stringers 12 and 14 at a wall side, and 16 and 18 at the open side; the stringers can be elongated planar boards having an upper surface, a lower surface, a front surface and a back surface. In many stairway constructions these stringers may be 2×4, 2×6 or 2×10 boards determined by the load to be expected in the use of the finished stairway. Upper stringer 12 and lower stringer 14 are a parallel pair or set on the left side of the stairway forming a skirt board as shown, and upper stringer 16 and lower stringer 18 are a parallel pair or set on the right side of the stairway 10 forming a fascia board as shown. When assembled as illustrated in this drawing, the parallel stringers 12/14 form a skirt board 20 at the left and stringers 16/18 form a fascia board 22 at the right side of the stairway. Stringers 12 and 14 may be attached by conventional means to the studs 20 within the wall of the left to the stairway. Sheet rock 26 is shown attached to the studs 20 and above the skirt board assembly 20. At the right side of the stairway 10 as shown, the fascia board 22 finished the edge of the stairway. A molding 28 may be attached to the top of the fascia board 20 to complete the finish at that edge of the stairway and a molding 30 may be attached to the top of the skirt board 22 to finish that edge.

Also shown in FIG. 1 are risers 32 and treads 34 and in the broken-away portion at the left side of the first tread 34 a bracket 36 is shown as attached to the stringers 12 and 14 in a manner to be described later.

The joint between the stringers 12/14 and 16/18 illustrates the complementary contouring of the lower face 121 of stringer 12 and the upper face 141 of stringer 14 in a tongue and groove cooperation. The front surface 12F and 14F of each of the stringers is contoured at the edge of the lower face 121 of stringer 12 and upper face 141 of stringer 14 to provide a finished feature to the tongue and groove cooperation faces and to add a finish feature to the assembled fascia board 20. These features and elements will be further described hereinafter.

Figure 2:
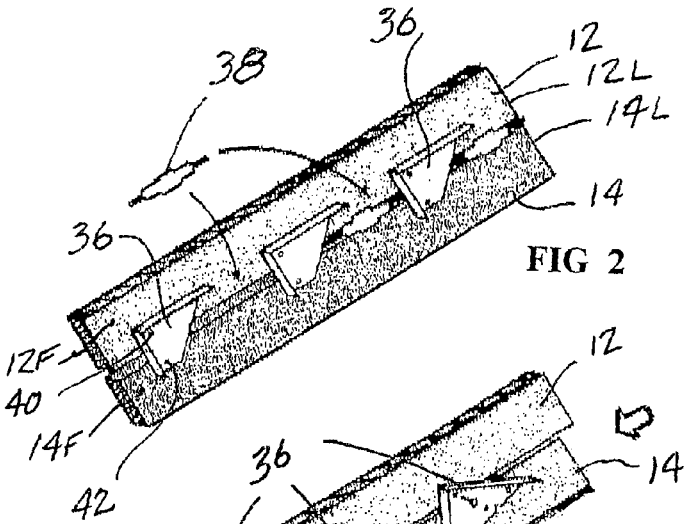
FIG. 2 is a perspective showing of the initial assembly of parallel stringers, brackets and spacers.

FIGS. 2-5 illustrate the use of the present apparatus in the formation of a stairway including the slope of the stairway, the alignment of brackets and the assembly of the stringers to form the finished fascia board. In FIG. 2, a pair of parallel stringers 12 and 14 are shown in their spaced alignment. A plurality of tread/riser support brackets 36 are shown in their spaced alignment along the front surface 12F and 14F of stringers 12 and 14, respectively, and spaced along the stringers by spacers 38. The spacing between brackets 36 is predetermined in the design of the stairway and in the adjustment of the length of the spacers 38 which contact the adjacent faces of the brackets 36 to provide the appropriate space between steps in the final stairway. The function of the brackets 36 and the spacers 38 is more fully described in my previously listed issued patents. When spaced and aligned along the parallel stingers 12 and 14, the brackets are temporarily and pivotally attached to the stringers with a single attachment device, such as screws at 40 into stringer 12 and 42 into stringer 14, to at least temporarily hold the brackets on the stringers as shown in FIG. 2. The spacers 38 are then removed having served the purpose of spacing the brackets along the stringers.

Figure 3:
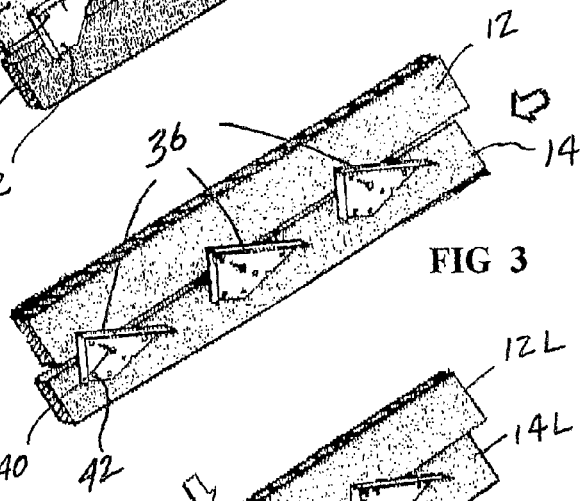
FIG. 3 is perspective showing of the relative movement of the parallel stringers to rotate the brackets for positioning treads and risers.

As shown in FIG. 3, the stringers 12 and 14 can then be moved relative to each other while remaining parallel to cause the brackets 36 to rotate about their pivotal mounting, each bracket rotating the same angular rotation as its adjacent bracket as the stringers are moved laterally with respect to each other. The movement of the stringers and rotation of the brackets is designed to place the brackets with their upper tread surface horizontal and the riser surface vertical as the stringers are aligned within an opening where a stairway of a designed slope is to be installed.

Figure 4:
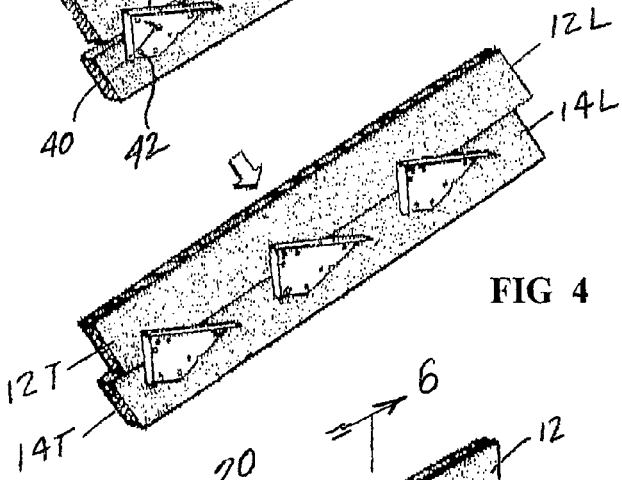
FIG. 4 is a perspective showing of the release of the pivotal mounting of the brackets to the upper stringer and the movement of that stringer to contact the lower stringer.

FIG. 4 illustrates the next step in bringing the two parallel stringers together along the lower surface of stringer 12 with the upper surface of stringer 14. In this step, the temporary attachment 40 of all of the brackets 36 is released and the upper stringer 12 is then free to move down into contact with the lower stringer 14. The movement of the upper stringer 12 vertically down into contact with the lower stringer 14 moves the puncture hole that was made in the temporary pivotal attachment of bracket 36 to the upper stringer 12 to a position behind the bracket 36 and hides that puncture hole from view on the stringer. The brackets 36 are then permanently attached to the upper and lower stringers with the screws 40 and 42 and additional attachment means, such as screws, at the several precut holes in the brackets as shown. All of the attachment screws are on the face of the bracket and are hidden from view when the treads and risers are attached in the finished stairway. The leading ends 12L and 14L and the trailing ends 12T and 14T are then cut to fit and be attached to a sill or base board at the location where the stairway is to be installed. The final assembled stinger 12/14 and the brackets 36 are aligned and located for the finished construction of a stairway as illustrated in FIG. 1.

Figure 5:
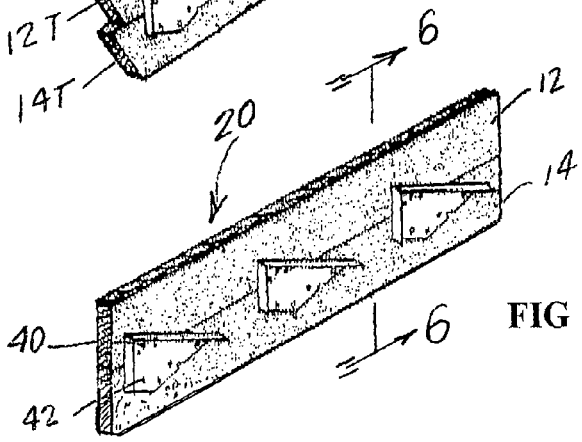
FIG. 5 is a perspective showing of the finished mounting of the brackets to the joined upper and lower stringers to present a finished skirt board appearance to the stairway.
Figure 6:
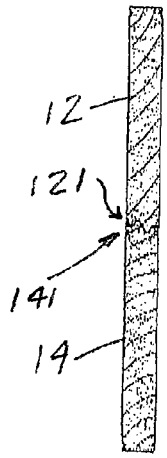
FIG. 6 is a sectional view through the parallel stringers along the lines 7-7 of FIG. 5.
Figure 7:
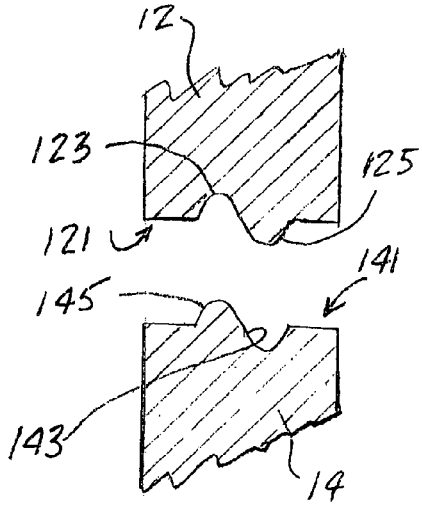
FIG. 7 is an enlarged sectional view of the joint between upper and lower stringers.

FIGS. 6 and 7 are sectional views taken along the lines 6-6 of FIG. 5 and show the feature of the present invention that illustrates the conversion of the parallel stringers 12 and 14 into a finished fascia board along the side of the stairway. As illustrated in FIGS. 1, 6 and 7 the lower surface 121 of stringer 12 and the upper surface 141 of stringer 14 are contoured into mating contours; in this case in the form of a tongue and groove, so as to mate when pressed together. In the FIG. 1, 6 and the enlarged view of FIG. 7, the contours are in the form of a groove 123 and a tongue 125 side-by-side across the lower surface 121 of stringer 12; and the upper surface 141 of the stringer 14 is contoured in the form of a tongue 145 and a groove 143 side-by-side across the surface. As seen in FIG. 7, the groove 123 and the tongue 145 are aligned to mate and the groove 143 and the tongue 125 are aligned to mate when the surfaces 121 and 141 are pressed together. By contouring these surfaces in a mating fashion, the stringers 12 and 14 form a finished skirt board when the stringers are pressed together. Further, the finished mating stringers 12 and 14 form the appearance of a finished fascia board as shown in FIG. 1. This assembly of a finished fascia board has been accomplished without excessive cutting of knee forms matching the treads and risers and can be accomplished by an inexperienced carpenter with limited skills and in an efficient manner taking a minimum of time to create a finished stairway assembly.

Figure 8:
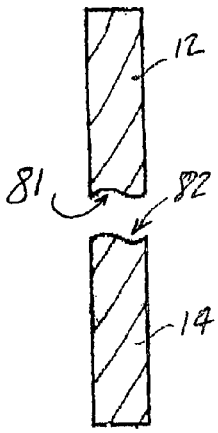
FIG. 8-14 are alternative forms of the contoured faces of parallel stringers.
Figure 9:
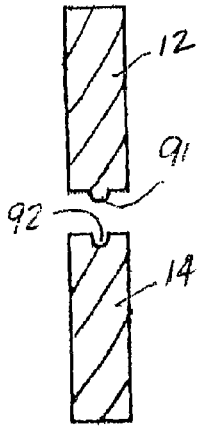
Figure 10:
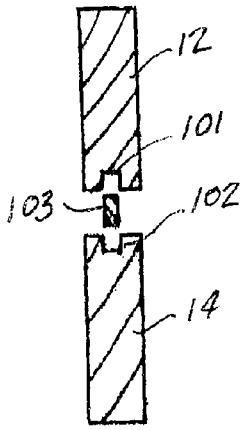
Figure 11:
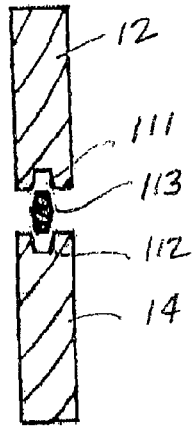
Figure 12:
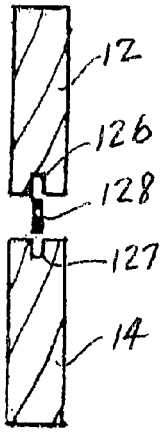
Figure 13:
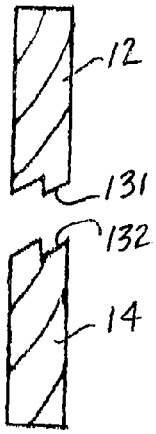
Figure 14:
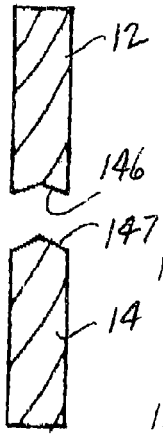

FIGS. 8 through 14 illustrate alternative forms of mating contours for the faces 121 and 141 of upper and lower stringers. Each of the illustrated forms can be created so as to produce a solid smooth exterior edge between the surfaces and front of the stringers or can be formed with features that will be described later. FIG. 8 illustrates a mating curve like a sine wave along the faces of the stringers 12 and 14. FIG. 9 illustrates a tongue 91 and a groove 92 along the faces of the stringers 12 and 14. It should be understood that the tongue can be on the stringer 14 and the groove can be on the stringer 12. A tapered slot and a tapered groove formed with the same angle of taper can be substituted for the tongue and groove form as shown. FIG. 10 illustrates the formation of a slot 101 in the stringer 12 and a slot 102 in the stringer 14 and the use of a solid member or spline 104 that can be inserted in the mating slots (and glued if needed) to maintain the mating stringers in their mated alignment. FIG. 11 illustrates the use of a tapered slot 111 in the stringer 12, a tapered slot 112 in the stringer 14 and an elongated member or tapered spline 113 for matching and mating the faces of the stringers 12 and 14. FIG. 12 illustrates the formation of a slot 126 in the stringer 12 and a slot 127 in the stringer 14 for the accommodation of a biscuit 128 which may be glued into the slots 126 and 127 to provide additional strength to the mated surfaces. FIG. 13 illustrates a tapered shiplap surface 131 on the stringer 12 and a tapered shiplap surface 132 on the stringer 14; these surfaces mate in a locking manner when the stringers are mated. FIG. 14 illustrates a "V" groove 146 in the stringer 12 and "V" extension 147 in the stringer 14; the groove and extension mate and align the stringers when the stringers are mated. Further alternative contours can be provided in the mating upper and lower surfaces of mating stringers to accomplish the desired smooth finished appearance of the fascia board of a stairway.

Figure 15:
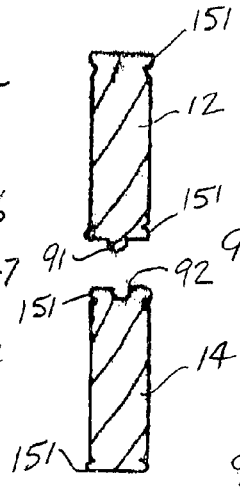
FIG. 15 is an alternative form for finished features along the face of a stringer.

FIG. 15 illustrates an additional surface feature that may be added to the stringers 12 and 14 wherein the upper and lower edges of the face of the stringer can be milled with a formed feature that can finish the top of the skirt board and the mating surface of the stringers that form the skirt board. Such a feature is illustrated in FIG. 1 along the joint forming the skirt board.

Figure 16:
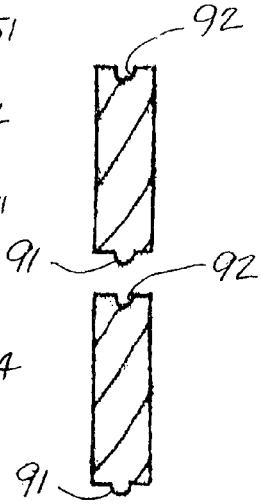
FIG. 16 is an illustration of contoured surfaces on both ends of a stringer to permit the stringer to be reversible as an upper or lower stringer.

FIG. 16 illustrates the formation of contoured surfaces at both ends of stringers, here shown as tongue and groove contours, will permit the stringers to be reversible and used as either the upper or lower stinger in the construction of a stairway in accord with the present invention.

Figure 17:
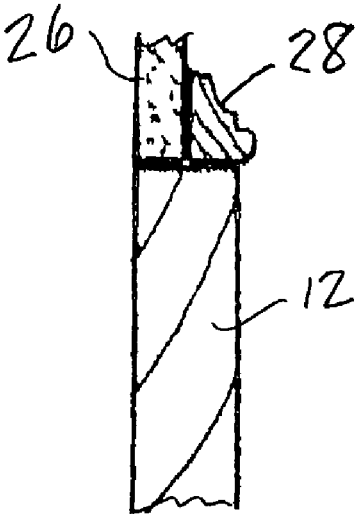
FIGS. 17 and 18 are sectional illustrations of added molding elements at the finished edge of a stringer now serving as a skirt board as in FIG. 1.
Figure 18:
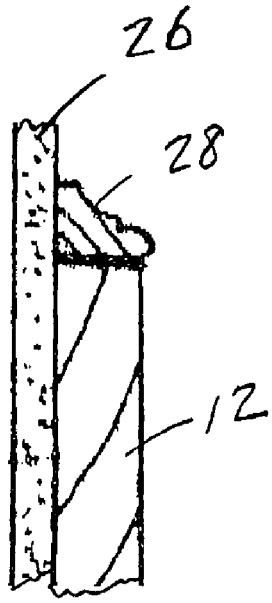
Figure 19:
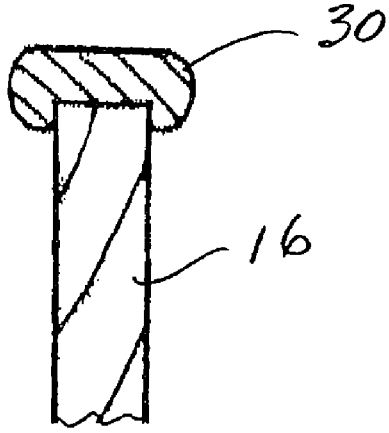
FIG. 19 is an illustration of a finished cap along the top of an exposed edge of a skirt board as shown in FIG. 1.

FIGS. 17 and 18 illustrate finishing molding elements that can be added to the upper surface of the stringer 12 now formed as the fascia board of a stairway as illustrated in FIG. 1. FIG. 17 illustrates a molding 28 against the sheetrock 26 and along the top of the stringer 12 and FIG. 19 illustrates a molding along the top of the stringer 12 and against the sheetrock 26. FIG. 19 illustrates the use of a molding 30 on the upper surface of a stringer 16 as illustrated in FIG. 1. Each of these moldings, and other finishing elements can be added to the stringer/skirt/fascia board assembly within the scope of the present invention.

The foregoing description has described a stairway stringer and finished skirt/fascia board combination formed by using a first and second parallel stringer and pivotally mounted tread/riser support brackets wherein the stringers are first used to support spaced pivotally mounted brackets along a front surface of the parallel stringers and then used to rotate the brackets to a desired horizontal and vertical alignment in a desired slope for the stairway by relative movement of the parallel stringers with respect to each other. After a desired slope is attained, the temporary attachment of the brackets to the upper stringer is released and the upper stringer is moved vertically toward the lower stringer to move the lower surface of upper stringer into a mating alignment with the upper surface of the lower stringer. In this mating alignment the mating surfaces of the upper and lower stringers form a finished fascia board along the stairway. The brackets are then permanently attached to the stringers with sufficient attachment screws or the like to assure adequate support for treads and risers as well as the weight of persons using the stairway. The mating faces of the upper and lower stringers can be contoured to provide a smooth and strengthened joint between the two stringers and produce an aesthetic appearance to the skirt/fascia board; the contours being in many different forms that provide for secure and finished appearance to the formed skirt/fascia board.

While certain preferred embodiments of the invention have been specifically disclosed, it should be understood that the invention is not limited thereto as many variations will be readily apparent to those skilled in the art and the invention is to be given it broadest possible interpretation within the terms of the following claims.

I claim:

1. A stairway stringer and finished stairway skirt board combination for use in constructing a stairway using first and second parallel stringers and pivotally mounted tread/riser support brackets wherein a) said stringers comprising an elongated planar board having an upper surface, a lower surface, a front surface and a back surface, b) at least one of said upper or lower surfaces formed with a contoured face adapted for mating cooperation with a similar formed upper or lower surface of a parallel stringer, c) said stringers being adapted at their front surface for pivotally mounting a plurality of spaced and aligned tread/riser support brackets, d) said first stringer being aligned vertically and parallel to said second stringer, each stringer adapted for pivotally mounting said plurality of spaced tread/riser support brackets to establish an upper and lower parallel stinger, e) said pivotal mountings of said brackets to said stringers adapted to permit said parallel stringers to be moved parallel to each other and to rotate said brackets about said pivotal mountings on each stringer, f) said pivotal mounting of said brackets on said upper stinger being releasable to permit said upper stringer to be moved vertically with respect to said lower stringer so as to engage a lower surface of said upper stringer with the upper surface of said lower stringer and to engage said contoured face of each stringer into mating cooperation, g) said vertically moved upper stringer being adapted i) for substantially permanent remounting of said brackets to said front surface of said upper stringer, ii) for concealing behind said substantially permanent remounting of said brackets any mounting mark on said front surface of said upper stringer from said prior pivotal mounting of said brackets, iii) and for engaging said contoured face of each of said stringers in mating cooperation to produce said substantially smooth finished stairway skirt board appearance at said engaged surfaces of said upper and lower stringers, wherein said contoured face of said upper or lower surface is a tapered slot in one of said upper or lower surface and a tapered extension in the other of said upper or lower surface, said tapered slot and said tapered extension having the same angle of taper so as to mate with a similarly formed upper or lower surface of a second stairway stringer to produce said substantially smooth finished stairway skirt board when said first and second stringers are engaged at said slot and tapered extension.

2. A stairway stringer and finished stairway skirt board combination for use in constructing a stairway using first and second parallel stringers and pivotally mounted tread/riser support brackets wherein a) said stringers comprising an elongated planar board having an upper surface, a lower surface, a front surface and a back surface, b) at least one of said upper or lower surfaces formed with a contoured face adapted for mating cooperation with a similar formed upper or lower surface of a parallel stringer, c) said stringers being adapted at their front surface for pivotally mounting a plurality of spaced and aligned tread/riser support brackets, d) said first stringer being aligned vertically and parallel to said second stringer, each stringer adapted for pivotally mounting said plurality of spaced tread/riser support brackets to establish an upper and lower parallel stinger, e) said pivotal mountings of said brackets to said stringers adapted to permit said parallel stringers to be moved parallel to each other and to rotate said brackets about said pivotal mountings on each stringer, f) said pivotal mounting of said brackets on said upper stinger being releasable to permit said upper stringer to be moved vertically with respect to said lower stringer so as to engage a lower surface of said upper stringer with the upper surface of said lower stringer and to engage said contoured face of each stringer into mating cooperation, g) said vertically moved upper stringer being adapted i) for substantially permanent remounting of said brackets to said front surface of said upper stringer, ii) for concealing behind said substantially permanent remounting of said brackets any mounting mark on said front surface of said upper stringer from said prior pivotal mounting of said brackets, iii) and for engaging said contoured face of each of said stringers in mating cooperation to produce said substantially smooth finished stairway skirt board appearance at said engaged surfaces of said upper and lower stringers, wherein said contoured surface of said upper or lower surface is a groove formed into the face of each surface, said groove adapted to be engaged by an inserted member into said groove in each of a pair of mating upper and lower stringers along at least a portion of said groove.

3. The inserted member of claim 2 being a biscuit or elongated element adapted to engage said groove and extend beyond said groove and into a groove of a mating stringer.

* * * * *